US007721544B2

(12) United States Patent
Numoto et al.

(10) Patent No.: US 7,721,544 B2
(45) Date of Patent: May 25, 2010

(54) ACTUATOR

(75) Inventors: Kenji Numoto, Tatsuno (JP); Mikio Yabuta, Tatsuno (JP)

(73) Assignee: Daicel Chemical Industries, Ltd., Osaka-shi (JP)

( * ) Notice: Subject to any disclaimer, the term of this patent is extended or adjusted under 35 U.S.C. 154(b) by 0 days.

(21) Appl. No.: 11/960,580

(22) Filed: Dec. 19, 2007

(65) Prior Publication Data

US 2008/0238058 A1 Oct. 2, 2008

Related U.S. Application Data

(60) Provisional application No. 60/884,560, filed on Jan. 11, 2007.

(30) Foreign Application Priority Data

Dec. 27, 2006 (JP) ..... 2006-351435

(51) Int. Cl.
*F01B 29/08* (2006.01)
*F02N 13/00* (2006.01)

(52) U.S. Cl. ..... 60/635; 60/636; 60/632

(58) Field of Classification Search ..... 60/632, 60/635, 636; 285/18, 317, 397, 417, 921
See application file for complete search history.

(56) References Cited

U.S. PATENT DOCUMENTS 3,227,030 A * 1/1966 Preziosi et al. ..... 411/521
3,245,703 A * 4/1966 Manly ..... 285/319
4,091,621 A * 5/1978 Patrichi ..... 60/635
4,860,698 A * 8/1989 Patrichi ..... 123/24 R
5,161,830 A * 11/1992 Abe ..... 285/148.27
5,259,650 A * 11/1993 Gnauert et al. ..... 285/39
5,642,619 A * 7/1997 Matsuki et al. ..... 60/632
6,675,692 B1 1/2004 Goetz et al.
6,959,548 B2 * 11/2005 Borg et al. ..... 60/632
2005/0016371 A1 1/2005 Borg et al.

FOREIGN PATENT DOCUMENTS

EP 1162333 B1 12/2005

* cited by examiner

*Primary Examiner*—Thomas E Denion
*Assistant Examiner*—Christopher Jetton
(74) *Attorney, Agent, or Firm*—Birch, Stewart, Kolasch & Birch, LLP

(57) ABSTRACT

An actuator includes;

a cylinder connected to an ignition device;

a piston slidably accommodated inside the cylinder, the piston having, in a desired section in the length direction, an enlarged diameter portion in which an outer diameter is enlarged; and a cylindrical stopper attached to an inner peripheral surface of the cylinder. The stopper includes, a main body portion fixed to the inner peripheral surface of the cylinder, and a nail portion which inwardly projects from the main body portion and is formed of an elastic material, wherein before activation of the ignition device, the piston is inhibited from moving in an axial direction by causing the nail portion to contact a part of the enlarged diameter portion, and after activation of the ignition device, the piston is inhibited from moving in a backward direction by causing the nail portion to contact another part of the enlarged diameter portion.

8 Claims, 6 Drawing Sheets

ACTUATOR

This nonprovisional application claims priority under 35 U.S.C. §119(a) on Patent Application No. 2006-351435 filed in Japan on 27 Dec. 2006, and 35 U.S.C. §119(e) on U.S. Provisional Application No. 60/884,560 filed on 11 Jan. 2007, which are incorporated by reference.

BACKGROUND OF INVENTION

1. Field of Invention

The present invention relates to an actuator used in an 3 airbag type restraining device or the like.

2. Description of Related Art

As an occupant restraining device or a pedestrian protection device of a vehicle, there are, in addition to an airbag type restraining device, a device for lifting up the hood of a vehicle in order to protect a pedestrian and a device for retracting the steering wheel (shaft/column), and a pyrotechnic actuator is used in such devices.

There is a known actuator in which a pin (piston) is pushed out or retracted upon activation, and, in either case, it is necessary to fix the piston before activation so that it does not move.

In an actuator combined with the above-mentioned restraining device, even after driving the piston, the piston needs to be prevented from returning to its initial position, thus it is preferred, in terms of size and weight reduction of the entire device, that the structure for inhibiting the movement of the piston before and after the activation be simple.

US-B1 No. 6,675,692 relates to a pyrotechnic actuator. As shown in FIG. 1, there is disclosed an actuator in which a piston 2 is slidably disposed within a housing 1 and is driven by a detonator 3. An oblong cavity 2b is formed on the piston 2, and a projection 9 is caused to pass therethrough. A lock (locking element) 8 is disposed so as to surround the projection 9. When a free end 8a abuts on the projection 9 before activation, the piston is inhibited from moving. In FIG. 2, an object corresponding to the lock 8 shown in FIG. 1 is formed in plurality.

In FIG. 7, two studs 2z that are attached to the piston 2 are bent inward by at least a certain amount of force and pass through the piston 2 with respect to the projection. There is disclosed in the 11th through 17th lines of Column 5 that the piston 2 is fixed by the studs 2z before and after activation.

In the actuator of EP-B1 No. 1162333, a piston is disposed within a cylinder and a piston fixing member 13 locks a piston 2 prior to activation (upper left of the drawing). The fixing member 13 is in the form of a washer, and by fitting an inner peripheral portion thereof into an annular groove 12 formed on the piston 2, the piston is inhibited from moving before activation.

SUMMARY OF INVENTION

The present invention provides an actuator including:

a cylinder connected to an ignition device;

a piston slidably accommodated inside the cylinder, the piston having, in a desired section in the length direction, an enlarged diameter portion in which an outer diameter is enlarged;

a cylindrical stopper attached to an inner peripheral surface of the cylinder, the stopper including, a main body portion which is fixed to the inner peripheral surface of the cylinder, and a nail portion which inwardly projects from the main body portion and is formed of an elastic material, wherein before activation of the ignition device, the piston is inhibited from moving in an axial direction by causing the nail portion to contact a part of the enlarged diameter portion, after activation of the ignition device, the piston is inhibited from moving in a backward direction by causing the nail portion to contact another part of the enlarged diameter portion.

The invention also provides an actuator including:

a cylinder connected to an ignition device;

a piston slidably accommodated inside the cylinder;

a cylindrical stopper attached to an outer peripheral surface of the piston, the stopper including, a main body portion which is fixed to the outer peripheral surface of the piston, and a nail portion which outwardly projects from the main body portion and is formed of an elastic material, wherein before the activation of the ignition device, the piston is inhibited from moving in an axial direction by causing the nail portion to contact a peripheral edge of an opening portion of the cylinder, after the activation of the ignition device, the piston is inhibited from moving in a backward direction by the nail portion which has popped out of the cylinder and spreads wider than a diameter of the opening portion of the cylinder.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF INVENTION

Figure 1:
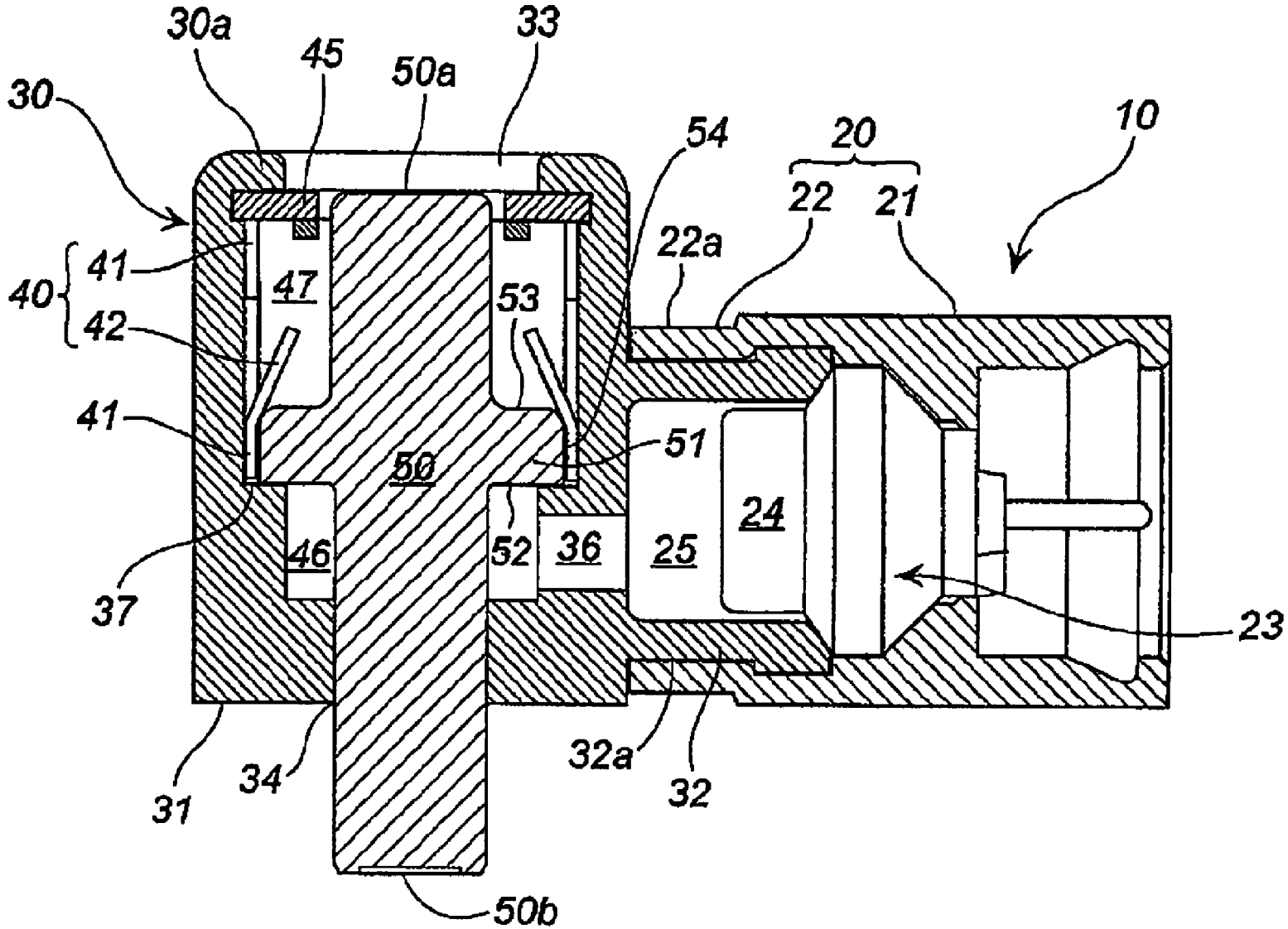
FIG. 1 shows a longitudinal sectional view of the actuator of the present invention in a state before activation.

In FIG. 1 of U.S. Pat. No. 6,675,692, the projection 9 deforms the free end 8a of the lock 8 at the time of activation and moves from a 2b' space to a 2b" space, but it is difficult to completely fix the piston after activation because of the wide 2b" space. Also, in FIG. 2, it is possible to fix the piston after activation, but the structure is complicated since a plurality of the locks 8 are used.

In FIG. 7 of U.S. Pat. No. 6,675,692, on the other hand, there is disclosed that the piston can be fixed before and after activation, but the movement of the piston is not locked in the drawing, particularly before activation, thus it is assumed that the locking function is not exercised sufficiently.

In the actuator of EP-B1 No. 1162333, when the piston moves upon activation of an igniter 5, the fixing member 13 is deformed (upper right of the drawing) and the piston is pushed out, but since the fixing member functions to inhibit the backward movement of the piston, the piston is inhibited from returning its initial position after the activation. However, in this structure, fixation of the fixing member itself is complicated, and in the embodiment, the fixing member is fixed between the actuator and a container A accommodating therein the entire actuator.

The present invention provides an actuator that is capable of fixing a piston by means of one component before and after activation, and has a simple structure.

By using the stopper having the nail portion made of an elastic member, the nail portion operates, similarly to a blade spring, to inhibit the movement of the piston before the ignition device is activated, and to inhibit backward movement of the piston after the ignition device is activated.

At least the nail portion of the stopper may be formed of an elastic member, but the entirety of the stopper may be formed from an elastic thin metal sheet. If the entirety of the stopper is formed from an elastic thin metal sheet, a predetermined section of the main body portion may be cut out into, for example, a rectangular, square, trapezoidal, or triangular shape (however, one side of the predetermined section is left uncut and the remaining sides are cut out) and one remaining side may be bent to form the nail portion.

By using the stopper having the nail portion made of an elastic member, the nail portion operates, similarly to a blade spring, to inhibit the movement of the piston before the ignition device is activated, and to inhibit backward movement of the piston after the ignition device is activated.

At least the nail portion of the stopper may be formed of an elastic member, but the entirety of the stopper may be formed from an elastic thin metal sheet. If the entirety of the stopper is formed from an elastic thin metal sheet, a predetermined section of the main body portion may be cut out into, for example, a rectangular, square, trapezoidal, or triangular shape (however, one side of the predetermined section is left uncut and the remaining sides are cut out) and one remaining side may be bent to form the nail portion.

According to the actuator of the present invention, the movement of the piston before activation and the backward movement of the piston after activation are inhibited by one component attached to the cylinder or piston.

Figure 2:
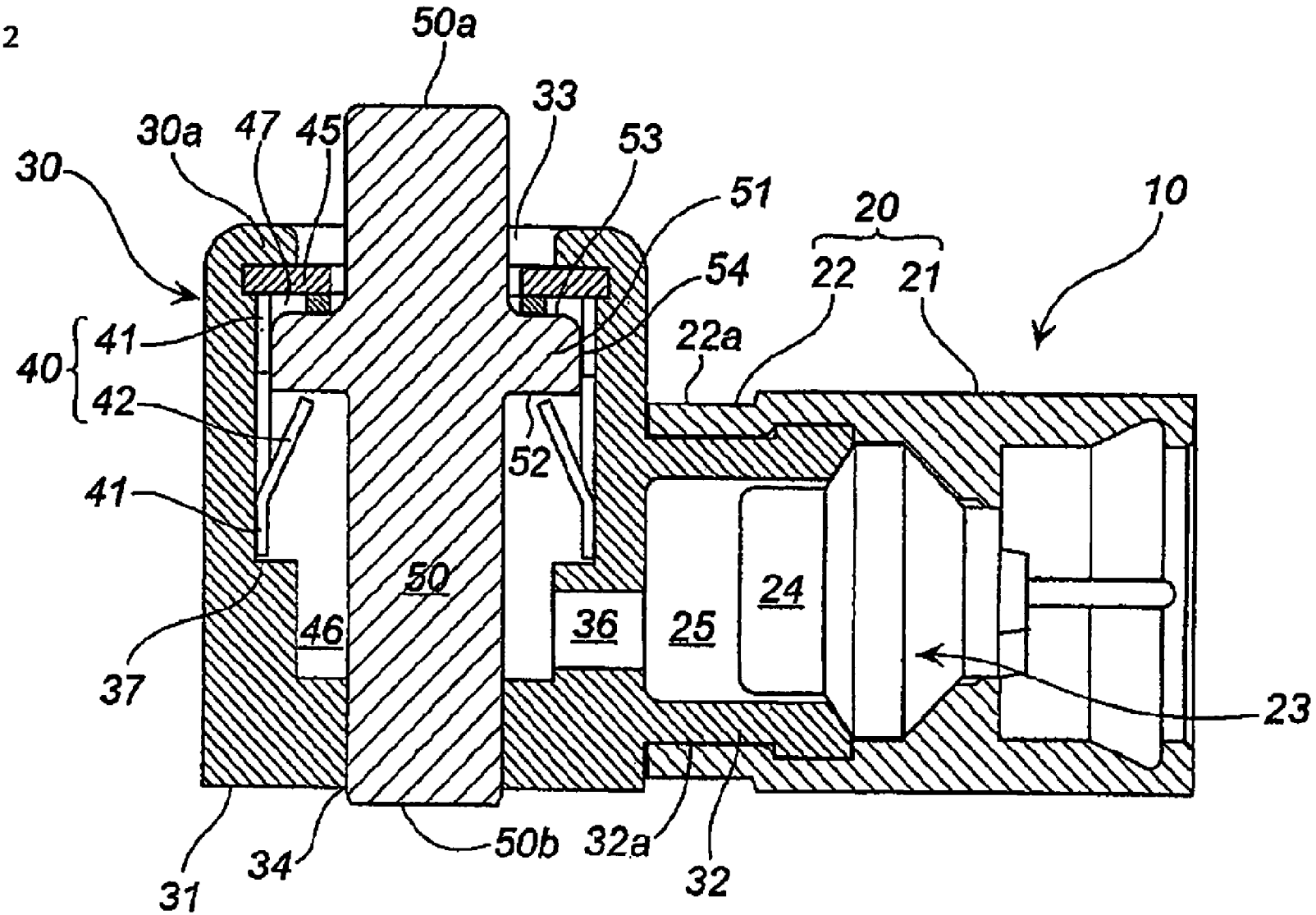
FIG. 2 shows a longitudinal sectional view of the actuator of the present invention in a state after activation.
Figure 3:
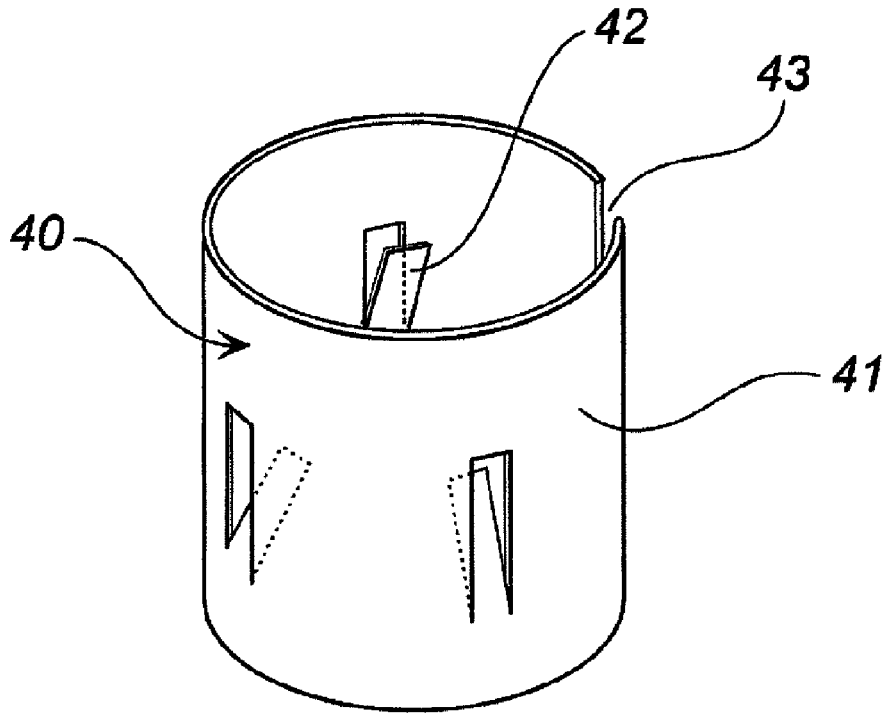
FIG. 3 shows a perspective view of a stopper of an embodiment different from that shown in FIG. 1.

EMBODIMENTS OF INVENTION (1) Actuator Shown in FIG. 1, FIG. 2

FIG. 1 and FIG. 2 each are a longitudinal sectional view of an actuator, FIG. 1 showing a state before activation and FIG. 2 showing a state after activation.

An outer shell of an actuator 10 is formed by integrating an igniter collar 20 and a cylinder 30. The igniter collar 20 has a main body portion 21 in contact with an igniter 23 and a collar tubular joining portion 22 extended from the main body portion 21. The cylinder 30 has a tubular piston accommodating portion 31 and a cylinder tubular joining portion 32 protruding from a peripheral surface of the piston accommodating portion 31. The igniter 23 is fixed to the cylinder tubular joining portion 32 by the igniter collar 20 and thereby connected to the cylinder 30.

The igniter collar 20 and the cylinder 30 are joined to each other in a state in which the cylinder tubular joining portion 32 is inserted into the collar tubular joining portion 22. There is no particular restriction on the joining method, but in the present embodiment, as shown in the drawings, the cylinder tubular joining portion 32, which is provided with a step (groove 32*a*) on the outer surface in advance, is covered by the collar tubular joining portion 22. The collar tubular portion 22 has originally no groove, however, when it covers the cylinder tubular joining portion, it is deformed to match the outer shape of the cylinder tubular joining portion 32, so that a groove 22*a* having the same shape as a groove 32*a* may be formed, thereby joining both tubular joining portions. It should be noted that the igniter 23 may be fixed to the cylinder tubular joining portion 32 without using the igniter collar 20.

The igniter 23 (the one used in a known actuator or gas generator for an airbag can be used) is fixed within an igniter accommodating space 25 surrounded by the igniter collar 20, the cylinder main body portion 21 and the cylinder tubular joining portion 32.

The cylinder 30 has at both ends thereof a first opening portion 33 and a second opening portion 34, and has on a side surface side thereof a communication hole 36 communicated with the igniter accommodating space 25.

In the cylinder main body portion 31, a step is formed on an inner peripheral surface between the first opening portion 33 and the second opening portion 34, and an annular surface 37 facing the first opening portion 33 is provided in the step portion.

A tubular stopper 40 is attached between the first opening portion 33 of the cylinder main body portion 31 and the annular surface 37.

The tubular stopper 40 has a stopper main body portion 41 that is in contact with the cylinder main body portion 31, and a nail portion 42 that is obtained by cutting out a desired section of the stopper main body portion 41 into a rectangular shape (however, the three sides are cut out and the one narrow side is left uncut) and bending a leading end portion of the rectangle inward (inside a second piston accommodating space 47). It should be noted that the nail portion 42 may be formed by firmly fixing a plate-like object to the main body portion 41. It is preferred that the nail portion 42 be formed in plurality (two through eight, for example) at regular intervals in a peripheral direction.

The stopper 40 or the nail portion 42 is made of an elastic material such as a thin metal sheet of a stainless steel, iron or aluminum or the like. The nail portion 42 performs a predetermined stopper function, similarly to a blade spring, by being deformed when external force is applied thereto and by being restored immediately to its initial shape or a shape similar to the initial shape when the external force is removed.

A piston 50 accommodated in the cylinder 30 has, in a desired section in the length direction, a disk-like enlarged diameter portion 51 in which an outer diameter is enlarged. The disk-like enlarged diameter portion 51 has an annular second surface 53 facing the first opening portion 33 and an annular first surface 52 facing the second opening portion 34 side. A peripheral surface 54 of the disk-like enlarged diameter portion 51 abuts on the stopper main body portion 41, and a part of the annular first surface 52 abuts on the annular surface 37. The inside of the cylinder 30 is divided into a first piston accommodating space 46 and a second piston accommodating space 47 by the disk-like enlarged diameter portion 51.

Before activation, one end surface 50*a* of the piston 50 faces the first opening portion 33 but does not protrude from the first opening portion 33. The other end surface 50*b* of the piston 50 protrudes from the second opening portion 34 to the outside.

The stopper 40 is fixed by causing one end side opening portion thereof to abut on a stopper fixing member 45 attached to the first opening portion 33 side, an outer peripheral surface of the same to abut on the cylinder main body portion 31, and a part of an inner peripheral surface of the same to abut on the peripheral surface 54 of the disk-like enlarged diameter portion 51. The stopper fixing member 45 may have an annular shape and elasticity, and is fixed by bending a peripheral edge 30*a* of the first opening portion 33 inward.

The tubular stopper 40 is not required to have a complete tubular shape, and may have a slit 43 passing through vertically (or a slit 43 that does not pass through), as shown in F*ig*. 3. When using the stopper 40 having such a slit 43, the entirety of the stopper 40 is formed from an elastic member. Then, when such stopper 40 is inserted into the cylinder 30, the stopper 40 is inserted by pushing it so that the slit 43 is closed, and, when the force of pushing is released after the insertion, the slit 43 is restored to its original state so as to be opened, thus the insertion and fixation to the cylinder 30 can be performed easily.

Next, an operation of the actuator of the present invention is described using FIG. 1 and FIG. 2. It should be noted that, before the igniter 23 is activated, a boundary section between the annular second surface 53 and the peripheral surface 54 of the disk-like enlarged portion 51 is pressed by an inner side surface of the nail portion 42, thus the piston 50 is inhibited from moving in the axial direction.

By the activation of the igniter 23, a combustion product (flame, high-temperature gas, shockwave, or the like) is generated from an ignition portion 24. The generated combustion product flows into the first piston accommodating space 46 through the igniter accommodating space 25 facing the ignition portion 24 and the communication hole 36. Then, the annular first surface 52 of the disk-like enlarged diameter portion 51 is pressed by the combustion product, whereby the piston 50 moves in the axial direction. At this moment, the nail portion 42 is pressed toward the main body portion 41 and deformed, thus the movement of the piston 50 is not inhibited.

As shown in FIG. 2, when the piston 50 protrudes from the first opening portion 33 by a predetermined length, the piston 50 collides with the stopper fixing member 45 and thereby stops, and, at this moment, the nail portion 42 that is deformed in the direction of the main body portion 41 by the movement of the piston 50 returns to its initial shape, and then the leading end portion of the nail portion 42 is caused to abut on the annular first surface 52 and interposed between the annular surface 37 and the annular first surface 52, whereby the piston 50 is inhibited from being retracted into the cylinder 30. Moreover, the piston 50 is in a state in which the enlarged diameter portion 51 is sandwiched from both sides thereof by the stopper fixing member 45 and the nail portion 42, thus the piston 50 does not become shaky, maintaining the state shown in FIG. 2.

Figure 4:
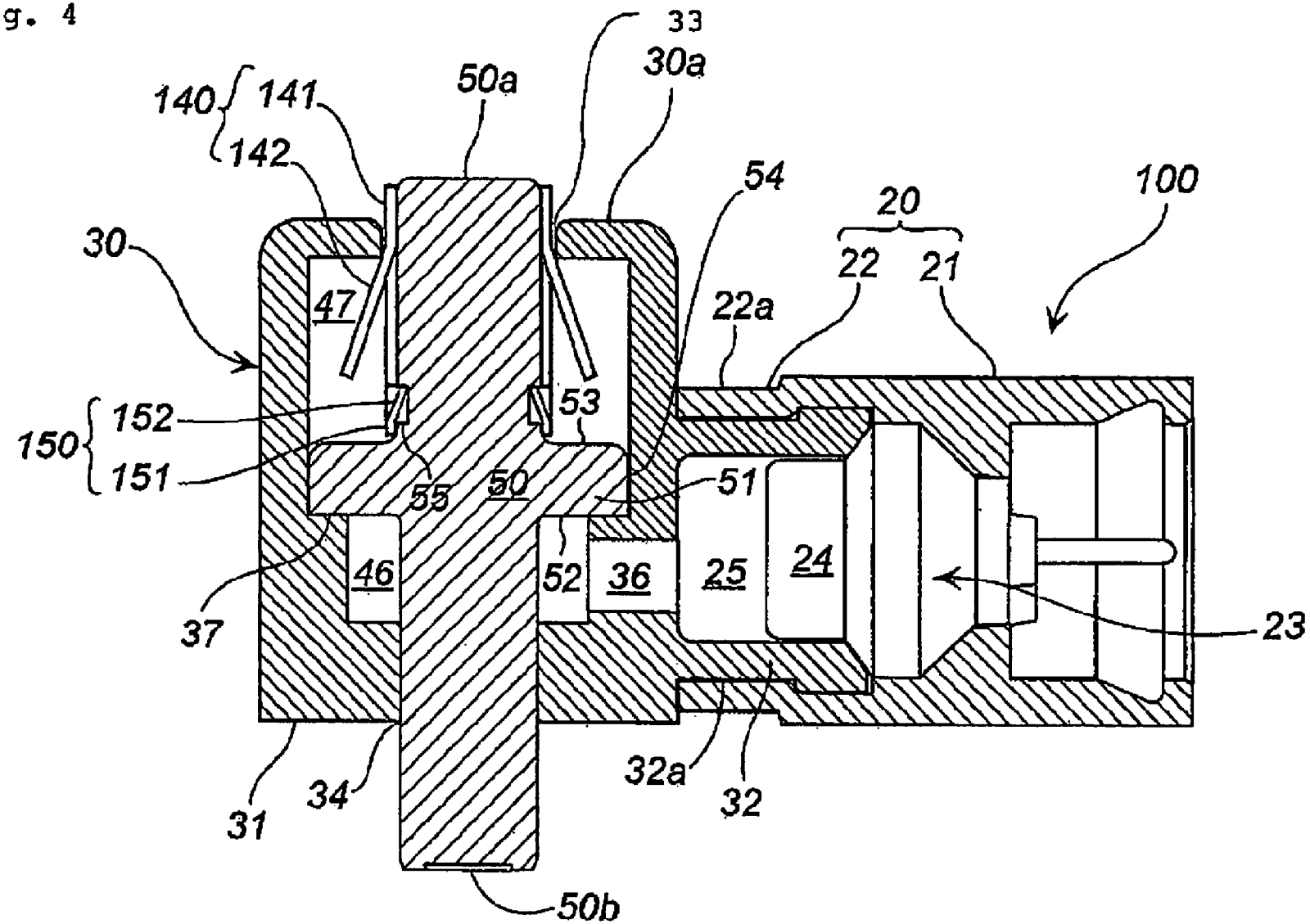
FIG. 4 shows a longitudinal sectional view of the actuator of another embodiment of the present invention in a state before activation.
Figure 5:
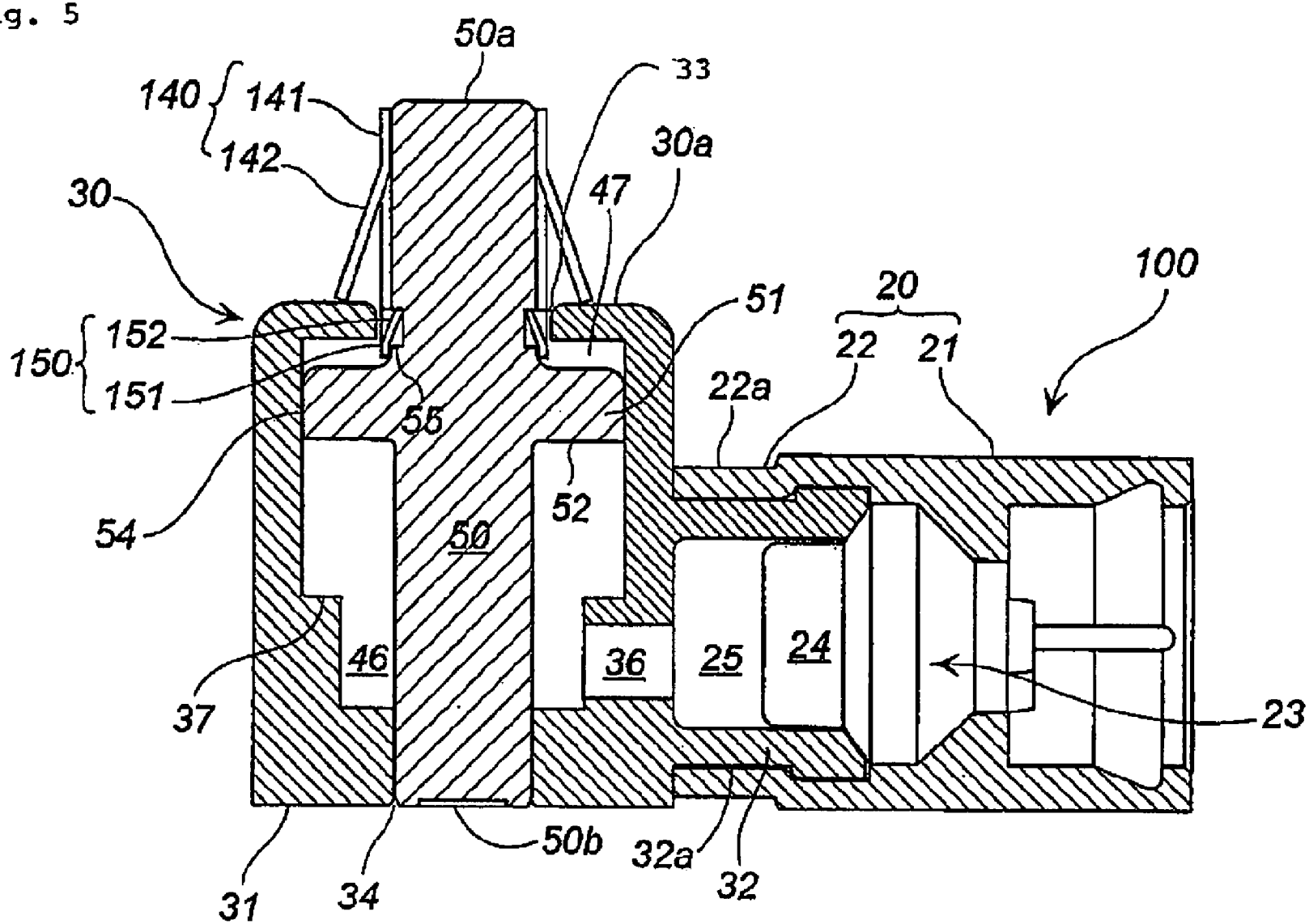
FIG. 5 shows a longitudinal sectional view of the actuator of another embodiment of the present invention in a state after activation.

(2) Actuator Shown in FIG. 4 and FIG. 5

FIG. 4 and FIG. 5 each are a longitudinal sectional view of an actuator of another embodiment, FIG. 4 showing a state before activation and FIG. 5 showing a state after activation. The basic structure of an actuator 100 shown in FIG. 4 and FIG. 5 is the same as that of the actuator 10 shown in FIG. 1 and FIG. 2, and the same reference numerals indicate the same components.

As shown in FIG. 4, a part of the end surface 50*a* side and a part of the end surface 50*b* side of the piston 50 protrude to the outside of the cylinder 30.

A tubular stopper 140 is attached to an outer peripheral surface between the disk-like enlarged diameter portion 51 and the end surface 50*a* of the piston 50.

The tubular stopper 140 has a stopper main body 141 that is in contact with the piston 50, and a nail portion 142 that is obtained by cutting out a desired section of the stopper main body portion 141 into a rectangular shape (however, the three sides are cut out and the one narrow side is left uncut) and bending a leading end portion of the rectangle outward (inside the second cylinder accommodating space 47). It should be noted that the nail portion 142 may be formed by firmly fixing a plate like object to the main body portion 141.

The stopper 140 or the nail portion 142 is made of an elastic material such as a thin metal sheet of a stainless steel, iron or aluminum. The nail portion 142 is deformed, similarly to a blade spring, when external force is applied thereto, and is restored immediately to its initial shape by removing the external force.

An annular groove (or a plurality of concave portions) 55 is formed on an outer peripheral surface of the piston 50 between the disk-like enlarged diameter portion 51 and the stopper 140, and a stopper fixing member 150 for fixing the stopper 140 to the piston 50 is formed at a position on the stopper 140 that faces the annular groove 55.

The stopper main body portion 141 protrudes, along with the piston 50, from the first opening portion 33 of the cylinder 30 to the outside, and the nail portion 142 is positioned inside the first opening portion 33. The nail portion 142 spreads wider than the diameter of the first opening portion 33, and an outer surface of the nail portion 142 abuts on and presses an inner surface of the first opening portion 33, thus, before the igniter 23 is activated, the piston 50 is inhibited from moving in the axial direction.

The stopper fixing member 150 is integrated with the tubular stopper 140, and has a main body portion 151 of the stopper fixing member, and a nail portion 152 that is obtained by cutting out a desired section of the stopper fixing member main body portion 151 into a rectangular shape (however, the three sides are cut out and the one narrow side is left uncut) and bending a leading end portion of the rectangle toward the inside of the annular groove 55. The nail portion 152 is tightly fitted in the annular groove 55, and the tubular stopper 140 is fixed to the piston 50 by means of this nail portion 152. It should be noted that the tubular stopper 140 may be fixed to the piston 50 by deforming (denting) the tubular stopper 140 to have the same shape as the annular groove 55, without using the stopper fixing member 150.

Figure 6:
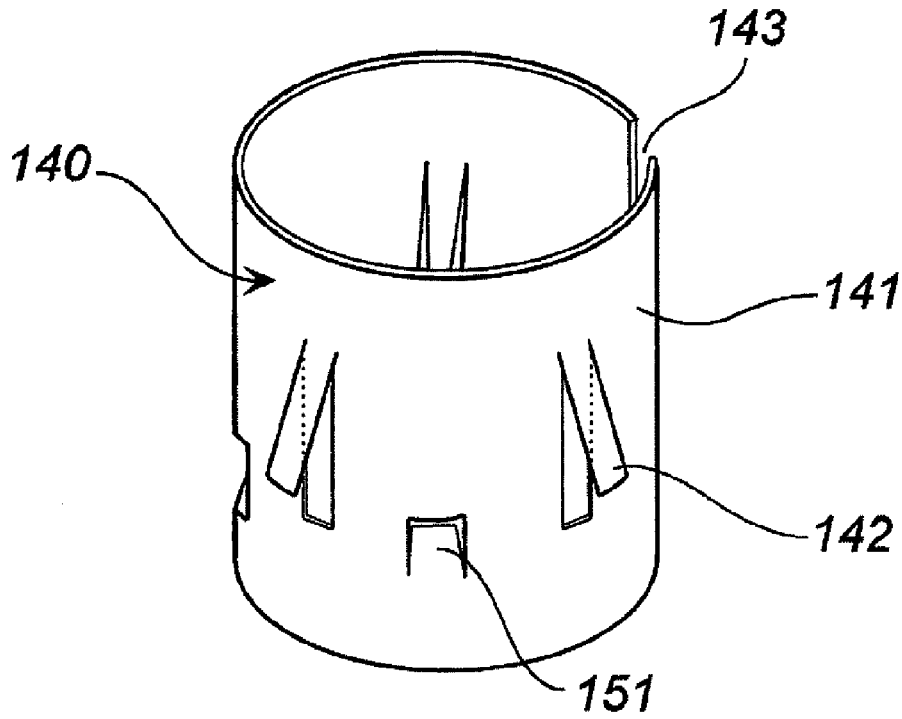
FIG. 6 shows a perspective view of the stopper of an embodiment different from that shown in FIG. 4.

The tubular stopper 140 may not have a complete tubular shape, and may have a slit 143 passing through vertically (or a slit 143 that does not pass through), as shown in FIG. 6. When using the stopper 140 having such a slit 143, the entirety of the stopper 140 is formed from an elastic member. Then, when such stopper 140 is inserted into the cylinder 30, the stopper 140 is inserted by pushing it so that the slit 143 is closed, and, when the force of pushing is released after the insertion, the slit 143 is restored to its original state so as to be opened, thus the insertion and fixation to the cylinder 30 can be performed easily.

Next, an operation of the actuator of the present invention is described using FIG. 4 and FIG. 5. It should be noted that, before the igniter 23 is activated, the nail portion 142 spreads wider than the diameter of the first opening portion 33, thus the piston 50 is inhibited from moving in the axial direction.

By the activation of the igniter 23, a combustion product (flame, high-temperature gas, shockwave, or the like) is generated from the ignition portion 24. The generated combustion product flows into the first piston accommodating space 46 through the igniter accommodating space 25 facing the ignition portion 24 and the communication hole 36. Then, the annular first surface 52 of the disk-like enlarged diameter portion 51 is pressed by the combustion product, whereby the piston 50 moves in the axial direction. At this moment, the nail portion 142 is pressed toward the main body portion 141 and deformed, thus the movement of the piston 50 is not inhibited.

As shown in FIG. 5, when the piston 50 protrudes from the first opening portion 33 by a predetermined length, the nail portion 142, that is once pressed toward the main body portion 141 and deformed, is restored into its initial shape or a shape similar to the initial shape, thus the nail portion 142 spreads wider than the diameter of the first opening portion 33. Therefore, the nail portion 142 abuts on an outer side surface 30*a* of the first opening portion 33, and the piston 50 is inhibited from being retracted into the cylinder 30. Moreover, even when a force that retracts the piston 50 into the cylinder 30 is applied, the operation of the stopper fixing member 150 prevents the stopper 140 from being dropped from the piston 50, thus the operation of the stopper 140 for inhibiting the movement of the piston 50 remains unaffected.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An actuator, comprising:

a cylinder connected to an ignition device;

a piston slidably accommodated inside the cylinder, the piston having, in a desired section in the length direction, an enlarged diameter portion in which an outer diameter is enlarged; and a cylindrical stopper made of an elastic material and attached to an inner peripheral surface of the cylinder, the stopper including, a main body portion fixed to the inner peripheral surface of the cylinder, the main body portion having a slit extending from a first end of the main body to a second end of the main body opposite to the first end, such that an outer peripheral surface of the main body is urged against the inner peripheral surface of the cylinder, and a nail portion inwardly projecting from the main body portion, the nail portion inhibiting the piston from moving in an axial direction prior to an activation of the ignition device by causing the nail portion to contact a part of the enlarged diameter portion, and inhibiting the piston from moving in a backward direction after the activation of the ignition device by causing the nail portion to contact another part of the enlarged diameter portion.

2. The actuator according to claim 1, wherein the nail portion of the cylindrical stopper is formed by cutting out the main body portion, except a part thereof, into a certain shape.

3. An actuator, comprising:

a cylinder connected to an ignition device;

a piston slidably accommodated inside the cylinder, the piston having a groove formed in an external surface thererof;

a cylindrical stopper made of an elastic material and attached to an outer peripheral surface of the piston, the cylindrical stopper including, a main body portion, a nail portion which outwardly projects from the main body portion, the nail portion inhibiting the piston from moving in an axial direction prior to an activation of the ignition device by causing nail portion to contact a peripheral edge of an opening portion of the cylinder, and inhibiting the piston from moving in a backward direction by popping out of the cylinder and spreading wider than a diameter of the opening portion of the cylinder, and a stopper fixing member formed by bending a portion of the main body in an inward direction, such that the cylindrical stopper is fixed to the piston by engaging the stopper fixing member with the groove.

4. The actuator according to claim 3, wherein the nail portion of the cylindrical stopper is formed by cutting out the main body portion, except a part thereof, into a certain shape.

5. The actuator according to claim 1, wherein the ignition device includes an igniter collar having a main body portion in which an igniter is accommodated, and a joining portion at which the ignition device is attached to the cylinder.

6. The actuator according to claim 5, wherein the cylinder has a communication hole, in a peripheral wall thereof, that receives pressure generated by the ignition device.

7. The actuator according to claim 3, wherein the ignition device includes an igniter collar having a main body portion in which an igniter is accommodated, and a joining portion at which the ignition device is attached to the cylinder.

8. The actuator according to claim 7, wherein the cylinder has a communication hole, in a peripheral wall thereof, that receives pressure generated by the ignition device.

* * * * *